US009173457B2

(12) United States Patent
Lee

(10) Patent No.: US 9,173,457 B2
(45) Date of Patent: Nov. 3, 2015

(54) ZIPPER ASSEMBLY

(71) Applicant: Ok-Kyung Lee, Seoul (KR)

(72) Inventor: Ok-Kyung Lee, Seoul (KR)

(73) Assignee: KMK Co., Ltd. (KR)

( * ) Notice: Subject to any disclaimer, the term of this patent is extended or adjusted under 35 U.S.C. 154(b) by 200 days.

(21) Appl. No.: 13/669,581

(22) Filed: Nov. 6, 2012

(65) Prior Publication Data

US 2013/0205549 A1 Aug. 15, 2013

(30) Foreign Application Priority Data

Feb. 14, 2012 (TW) ..... 10-2012-0014943

(51) Int. Cl.
*A44B 19/30* (2006.01)
*A44B 19/26* (2006.01)

(52) U.S. Cl.
CPC ..... *A44B 19/26* (2013.01); *A44B 19/30* (2013.01); *Y10T 24/2513* (2015.01); *Y10T 24/2566* (2015.01)

(58) Field of Classification Search
CPC ..... A44B 19/30; A44B 19/26; A44B 19/303; A44B 19/24
USPC ..... 24/381, 388, 387, 415, 437, 418
See application file for complete search history.

(56) References Cited

U.S. PATENT DOCUMENTS

| | | | | | |
|---|---|---|---|---|---|
| 2,123,513 | A | * | 7/1938 | Marinsky | 24/388 |
| 2,583,386 | A | * | 1/1952 | Moehler | 24/433 |
| 2,728,125 | A | * | 12/1955 | Wild | 24/388 |
| 4,232,430 | A | * | 11/1980 | Friedberg | 24/388 |
| 4,326,319 | A | | 4/1982 | Friedberg | |
| 5,007,145 | A | * | 4/1991 | Kim | 24/433 |
| 5,131,120 | A | * | 7/1992 | Akashi | 24/433 |
| 5,412,849 | A | * | 5/1995 | Fudaki | 24/388 |

* cited by examiner

*Primary Examiner* — Robert J Sandy
*Assistant Examiner* — Michael Lee
(74) *Attorney, Agent, or Firm* — Park & Associates IP Law, P.C.

(57) ABSTRACT

A zipper assembly includes: a slider of a generally C-shaped cross section; a bottom stop fixed to an end of one side tape; and a locking unit fixed to a corresponding end of another side tape, the locking unit being separably coupled with the slider disposed above the locking unit to limit movement of the slider, wherein the locking unit selectively allows for and blocks the movement of the slider by coupling with or separation, in a vertical direction, from the bottom stop.

14 Claims, 10 Drawing Sheets

(A)

(B)

(A)

(B)

(A)

(B)

ZIPPER ASSEMBLY

REFERENCE TO RELATED APPLICATIONS

This application claims the priority benefit of Korean Patent Application No. 10-2012-0014943 filed on Feb. 14, 2012, the entire contents of which are incorporated herein by reference.

FIELD OF THE INVENTION

The present invention relates to a slider or zipper assembly with a slider coupled to a pair of tapes for engaging and disengaging operations of the zipper.

BACKGROUND OF THE INVENTION

Generally, a zipper is installed in bags, clothes, etc. to bind the edges of an opening, and is so very simple and convenient that it is widely used.

In a brief examination of a conventional zipper structure, teeth are arranged at each of opposing edges of a pair of tapes of fabric, and a slider with a structure that a front side and a rear side communicate with each other is coupled to one of the pair of tapes.

When the slider moves in a forward direction and the rows of teeth enter into the slider, the rows of teeth are interlocked with each other inside the slider and then are released through the rear side. On the contrary, when the slider moves in a backward direction, the interlocked teeth are separated and then the separated teeth are released through the front side.

However, the conventional zipper has several problems.

In detail, in order to fasten a zipper, a bottom stop of an end of a tape where the slider is not coupled should be inserted into the slider through the front side of the slider. However, if a user wears, for example, gloves, the user cannot perform a detail action and thus has a difficulty in inserting the bottom stop.

Also, in case some of a seam in the back side of the tape rear is taken to the inside of the slider, the movement of the slider stops. If the slider is forcibly moved, the seam is further taken so that the slider does not operate.

Further, since the slider does not stay at a constant site but moves forward or backward, users sometimes have a difficulty in rapidly grasping the slider.

Thus, the conventional zipper has a limitation in that the foregoing drawbacks cannot be solved if the structure thereof is not basically changed.

Meanwhile, U.S. Pat. No. 4,326,319 discloses a slider fastener which includes a first terminal provided with a locking element, and a second terminal coupled with the first terminal as the first terminal is inserted into the second terminal and rotates. However, since the second terminal is shaped in a container and is coupled with the first terminal as the first terminal rotates, two continuous operations should be performed for the coupling. Also, if a foreign material is introduced into the second terminal, the slider fastener has a fatal drawback in that the coupling is not achieved.

SUMMARY OF THE INVENTION

Accordingly, an object of the present invention is to provide a slider assembly with a completely novel concept and structure.

Another object of the present invention is to provide a slider assembly which can secure reliability for coupling and separation of teeth.

A further another object of the present invention is to provide a slider assembly which can perform coupling and separation of teeth.

Still another object of the present invention is to provide a slider assembly with a slider always maintaining a constant position in a state that the teeth are separated.

According to an aspect of the present invention, there is provided a slider assembly including: a slider shaped in a cylinder having an opened bottom, the slider of which both edges coupled with teeth are curved inward; a bottom stop fixed to an end of one side tape; and a locking unit fixed to an end of the other side tape to limit movement of the slider, wherein the locking unit allows for the movement of the slider by coupling with or separation from the bottom stop, and the teeth has a space for receiving the edge of the slider.

The slider may include a hook piece which is protruded from an inner wall of the slider, the locking unit may have stoppers in one pair which are coupled with facing each other with a spring in-between to be subject to a restoring force of the spring, the bottom stop has a anchor protruded vertically, and as the anchor is coupled with the stoppers, the stoppers in one pair are repelled each other or near each other such that the hook piece is hooked or not hooked to each of the stoppers.

The slider may include a pressure hook piece which is further protruded than the hook piece and is formed on the inner wall at a front side spaced apart from the hook piece, and as the pressure hook piece pressurizes each of the stoppers in one pair, the anchor is separated from the stoppers.

The locking unit may comprise: a main body formed at a center thereof with an opening; stoppers in one pair which are received on a surface of the main body, coupled to each other with a spring in-between and have a contact formed at a position intersecting each other; and a cover separably coupled to the main body so as to cover the surface of the main body.

The locking unit may include: a flange which is protruded in a lengthwise direction from both sides of the main body such that each of the edges of the slider is positioned under the flange; and a stop jaw may be horizontally protruded from both sides of a rear end of the main body to limit reward movement of the slider.

The bottom stop may have a hemi-spherical anchor protruded vertically, the anchor being supported by a supporter having a width less than a diameter of the anchor, wherein as the anchor passes between the contacts and is hooked on a hook jaw formed at a boundary between the anchor and the supporter, the separation of the anchor is prevented.

The teeth may have a meshing part and an attachment part integrally formed, the meshing part may have a groove formed at one side surface thereof for meshing, a protrusion formed at an opposing side surface, and the attachment part may be shaped in "C" and have a space for receiving the edge of the slider in the "C"-shaped attachment part, and the tape is fixed under the attachment part.

According to the above structure, even when a user cannot perform a detail action by hand, the coupling and separation of the teeth can be always performed reliably.

Also, a rapid coupling between the teeth and the slider can be obtained by a single simple action, i.e., pressure in the vertical direction.

Further, in a state that the teeth are separated, the slider can always maintain a constant position.

Furthermore, the possibility that some of a seam is taken to the inside of the slider can be minimized.

BRIEF DESCRIPTION OF THE DRAWINGS

The above objects and other advantages of the present invention will become more apparent by describing in detail exemplary embodiments thereof with reference to the attached drawings in which.

DETAILED DESCRIPTION OF THE INVENTION

Now, exemplary embodiments of the present invention will be described in detail with reference to the accompanying drawings.

Figure 1:
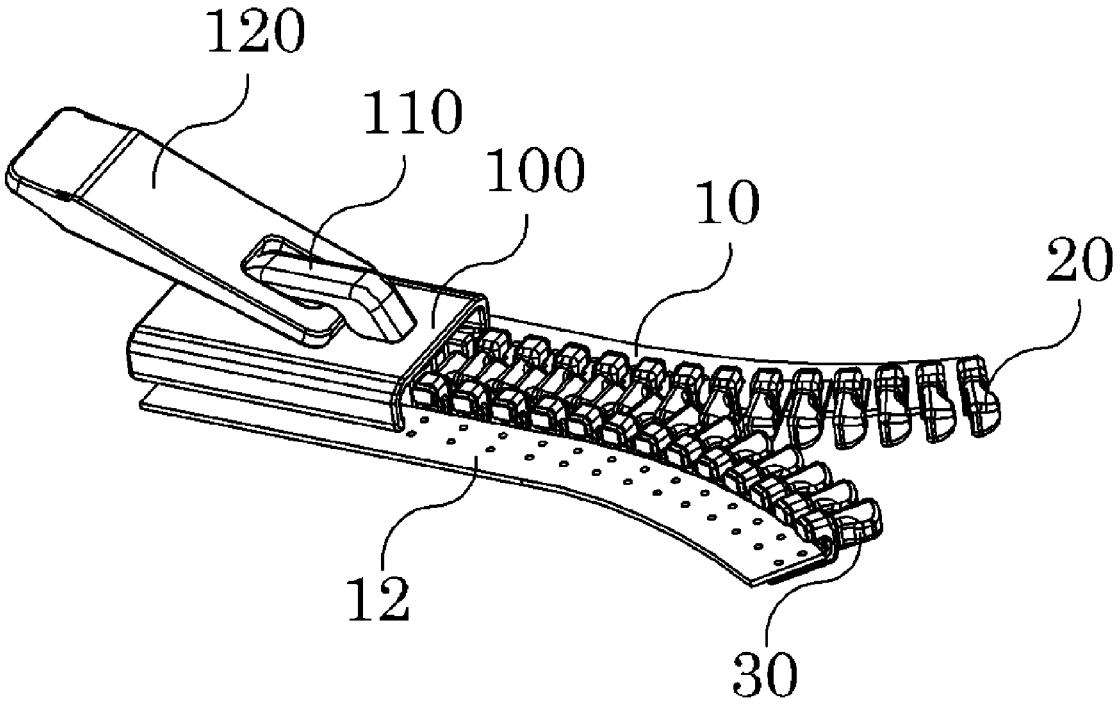
FIG. 1 shows a state that a slider assembly according to the present invention is coupled to tapes.
Figure 2:
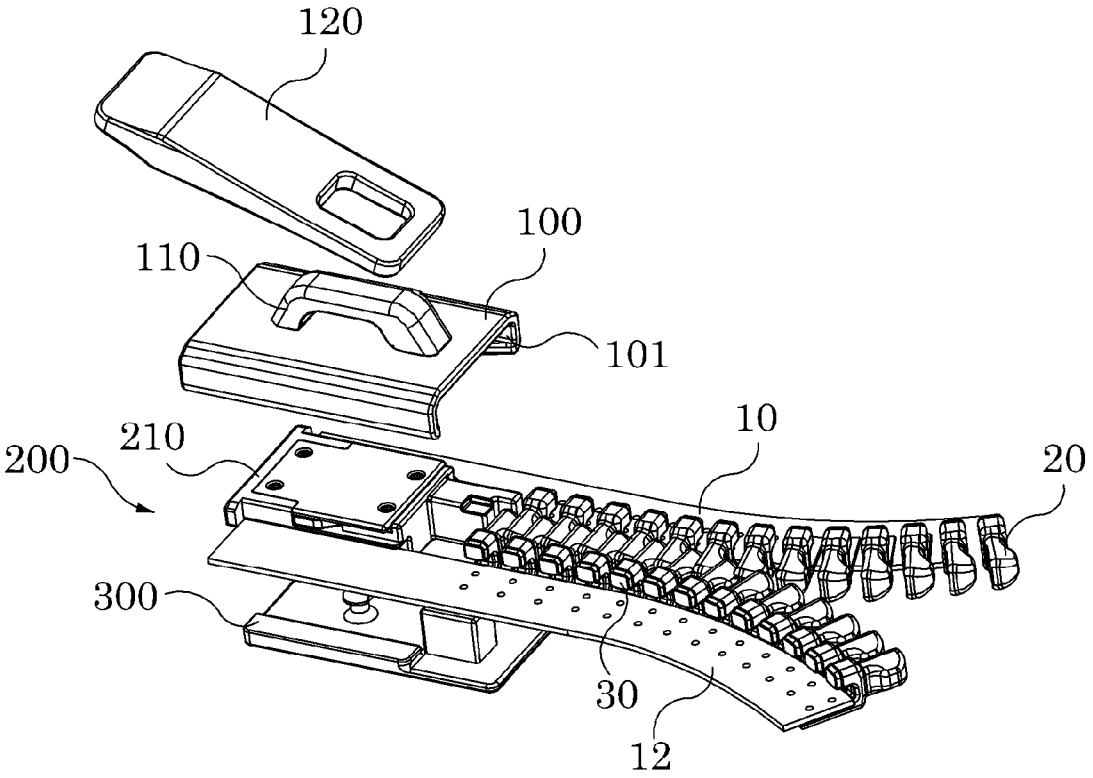
FIG. 2 is a disassembled perspective view of a slider assembly according to the present invention.

FIG. 1 shows a state that a slider assembly according to the present invention is coupled to tapes, and FIG. 2 is a disassembled perspective view of the slider assembly shown in FIG. 1.

As shown in FIGS. 1 and 2, a slider assembly includes: a slider 100 which is shaped in a container having an opened bottom and has a channel 101 formed by both edges, through which teeth 20 pass; a locking unit 200 fixed to an end of a tape 12 to limit movement of the slider 100, and a bottom stop 300 which is fixed to an end of the tape 12 and allows the locking unit 200 to control the movement of the slider 100. Teeth 20 and 30 have a space receiving both edges of the slider 100.

Hereinafter, respective elements constituting the slider assembly will be described in detail. For the convenience of description, the movement of the slider 100 for coupling of teeth 20 and 30 is referred to as "forward movement", and the opposite movement of the slider 100 for separation of the engaged teeth 20 and 30 is referred to as "reward movement".

Slider 100

Figure 3A:
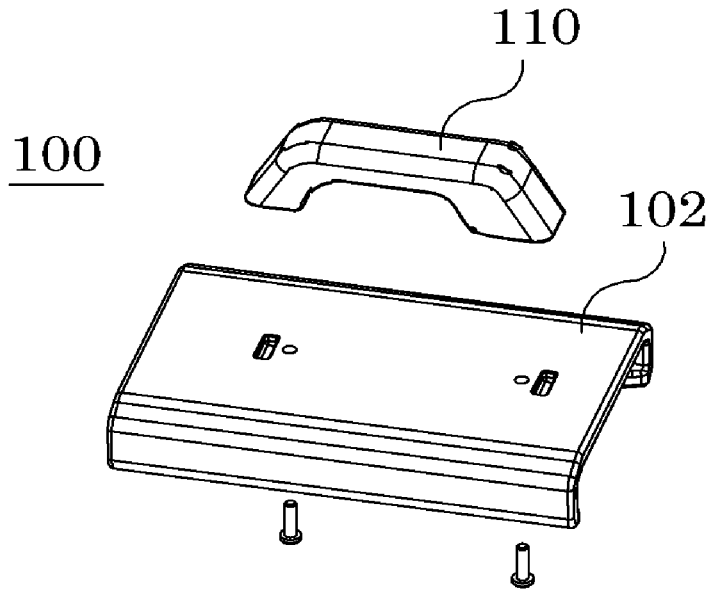
FIGS. 3A and 3B show a slider 100 applied to the present invention, respectively.
Figure 3B:
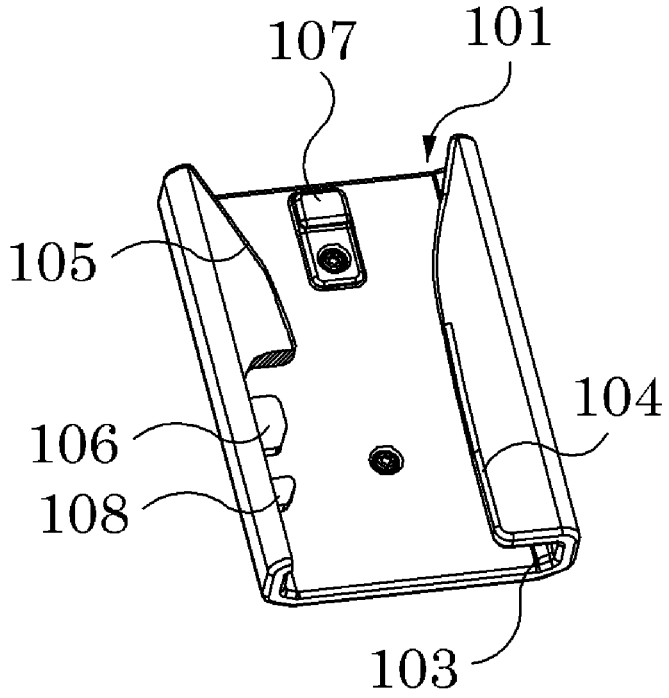

FIGS. 3A and 3B show a slider 100 applied to the present invention, respectively.

The slider 100 has a single body 101, and is shaped in a rectangular box of which a front inlet and a rear outlet communicate with the inside of the rectangular body.

End portions of both inner sidewalls 103 are curved inward to form edges 104 and 105 facing each other, and thus a channel 101 is resultantly defined in a lengthwise direction by the edges 104 and 105 and the inner sidewalls 103.

Preferably, the edges 104 and 105 in the inlet of the body 102 form a smooth curved portion such that the edges 104 and 105 are smoothly coupled with the teeth 20 and 30. A position determining protrusion 107 is protruded from a rear surface at a middle position of the inlet.

Referring to FIG. 3B, hook pieces 106 and 108 spaced apart by a predetermined interval from each other are protruded from both inner sidewalls, and interact with a stopper of the locking unit 200 to be described later. The hook piece 106 positioned at the front side is further protruded than the hook piece 108 positioned at the rear side, and a taper is formed at the rear side of each of the hook pieces 106 and 108.

As described later, the hook piece 106 is installed for the purpose of pressurizing the stopper of the locking unit 200, and the hook piece 108 is installed for the hooking thereof to the stopper of the locking unit 200.

A tap holder 110 is formed to a surface of the body 102, for example, by a screw, and is fixedly inserted into a full tap 120 as shown in FIG. 1.

Locking Unit 200

FIGS. 4A, 4B, 4C, and 4D show a locking unit 200 according to the present invention, respectively.

The locking unit 200 includes a main body 210 with an insertion hole 217 formed at the center thereof, stoppers 230 and 240 in one pair, which are mounted on a surface of the main body 210 and are coupled to each other with the spring 234 in-between while facing each other, and a cover 220 separably coupled to the main body 210 so as to cover the surface of the main body 210.

Preferably, a support protrusion 215 is horizontally protruded from the front side of the main body 210 and contacts and supports the first teeth 20 and 30 together with a protrusion of the bottom stop 300 to be described later. A groove 216 is formed at an upper surface of the support protrusion 215.

A receiving space 212 for receiving the stoppers 230 and 240 is formed in the main body 210, a boss 214 into which an insert 233 with a thread groove formed at an outer circumference thereof for coupling with the cover 220 is inserted is integrally, protrudingly formed in the main body 210, and an insertion opening 217 positioned between the facing stoppers 230 and 240 is formed. Also, flanges 213 are protruded in the lengthwise direction from both sides of the main body 210, and the edges of the slider 100 are positioned under the flanges 213 such that the slider 100 is prevented from being released upward.

Stop jaws 218 are formed at both sides of the main body 210 such that the slider 100 no longer moves backward.

Figure 4A:
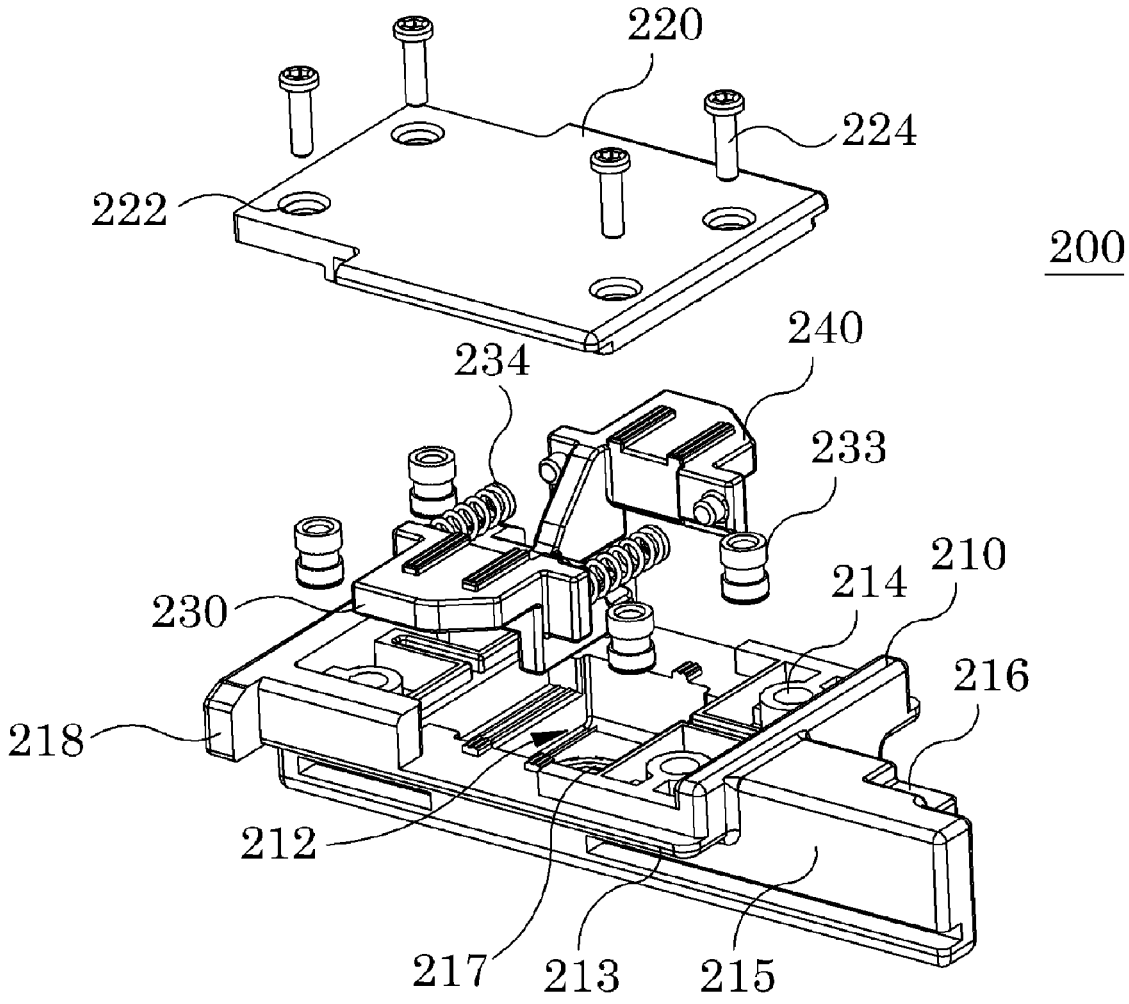
FIGS. 4A, 4B, 4C, and 4D show a locking unit 200 according to the present invention, respectively.
Figure 4B:
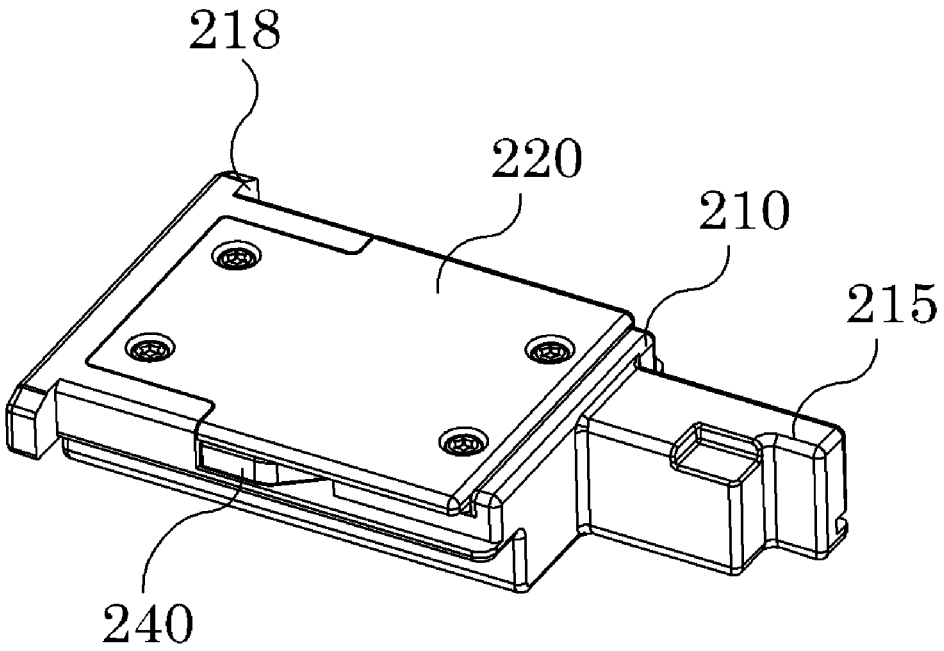
Figure 4C:
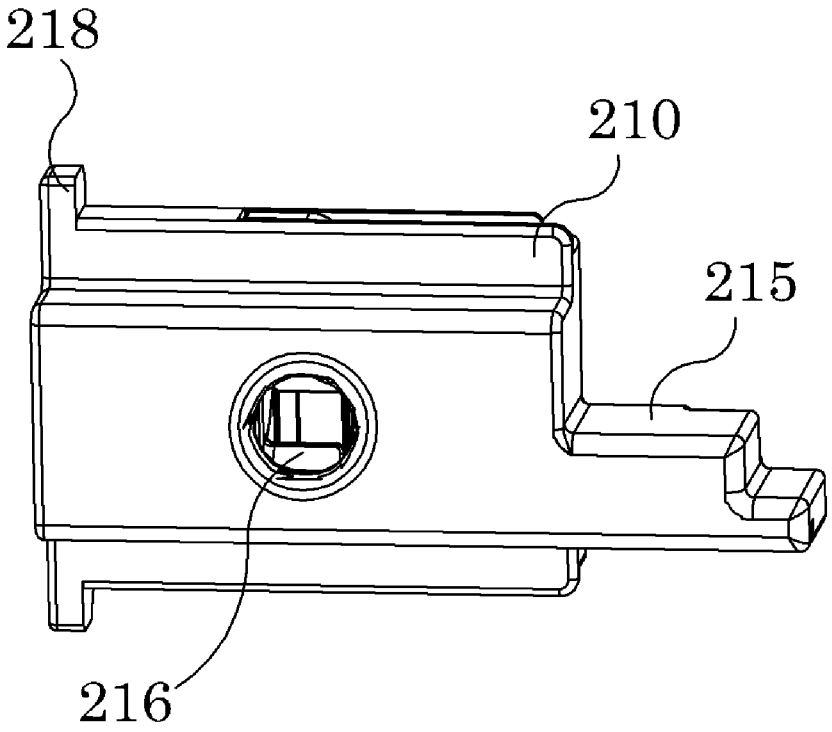
Figure 4D:
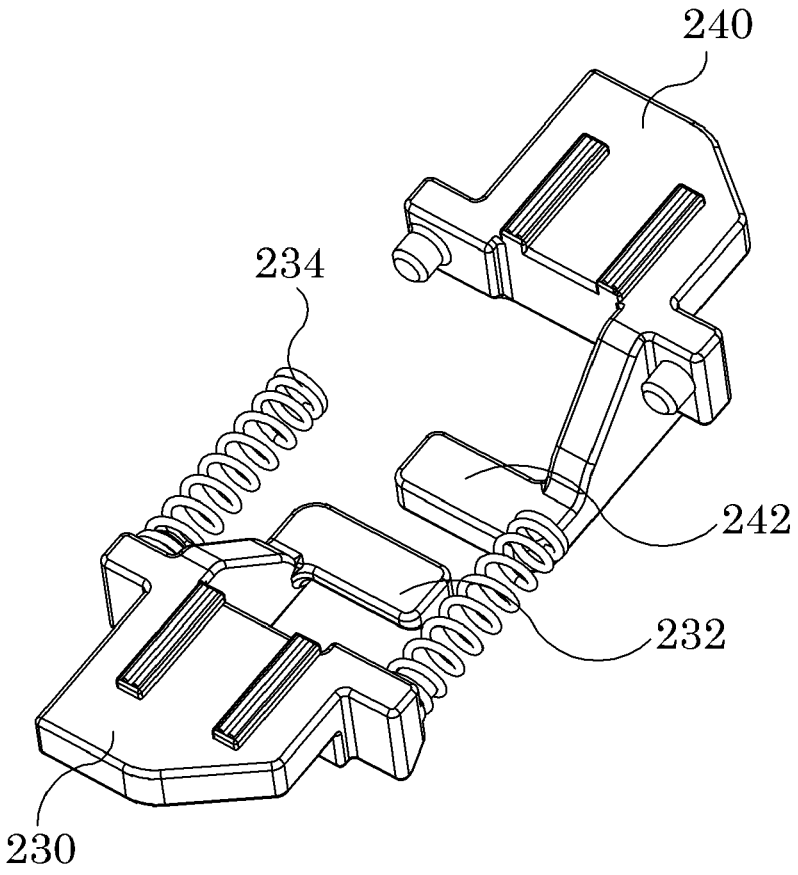

The stoppers 230 and 240 are positioned at edges of the insertion opening 217 and are provided with contacts 232 and 242 facing each other. The contacts 232 and 242 are positioned under the stoppers 230 and 240 positioned oppositely. That is, the state that the stoppers 230 and 240 are spaced apart from each other is shown in FIG. 4D, but in the state that the stoppers 230 and 240 are coupled with the spring 234 in-between, the contacts 232 and 242 are positioned under the stoppers 230 and 240 positioned oppositely.

Therefore, when the contacts 232 and 242 are pushed oppositely, on the contrary, the stoppers 230 and 240 become close to each other. When the contacts 232 and 242 are pulled from each other, on the contrary, the stoppers become more distant.

Preferably, contact surfaces of the contacts 232 and 242 are inclined so as to be matched with the shape of the anchor contacting the contacts 232 and 242.

Bottom Stop 300

Figure 5A:
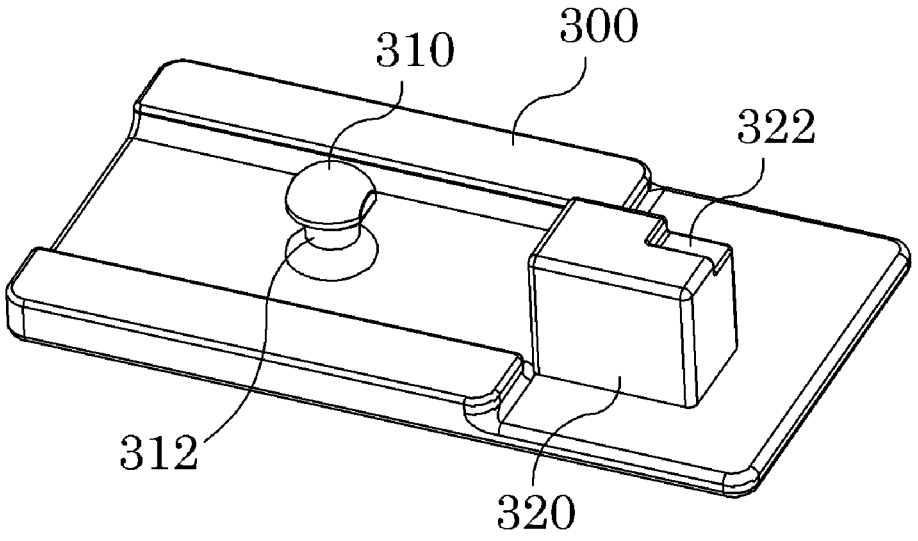
FIGS. 5A and 5B show a bottom stop 300 applied to the present invention, respectively.
Figure 5B:
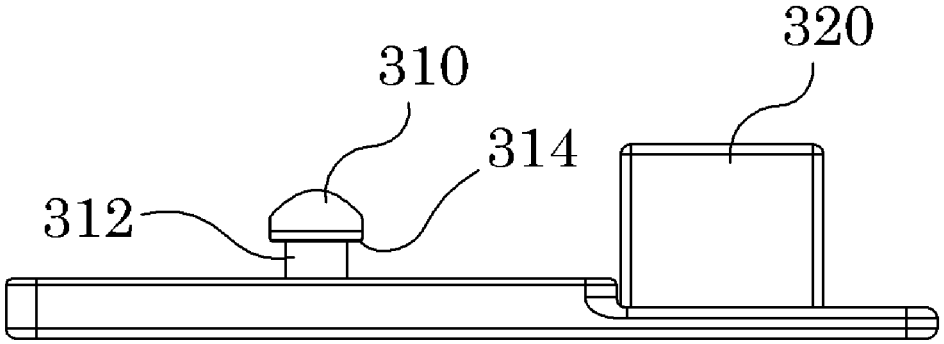

FIGS. 5A and 5B show a bottom stop 300 applied to the present invention, respectively.

The bottom stop 300 is fixed to an end portion of one of the tapes 12 and is coupled with or separated from the locking unit 200 to control the operation of the stoppers 230 and 240 of the locking unit 200.

An anchor 310 is protrudingly formed on a surface of the bottom stop 300 and is inserted into the insertion opening 217 formed in the main body 210.

Also, a support protrusion 320 is vertically protruded from the front surface of the bottom stop 300, and a groove 322 is formed at an upper portion of the support protrusion 320.

Referring to FIG. 5B, the anchor 310 shaped in a hemisphere is supported by a cylindrical support 312, and the support 312 has a diameter which is less than the diameter of the hemispherical anchor 310 such that a hook jaw 314 is formed at a boundary therebetween.

Teeth 20 and 30

Figure 6:
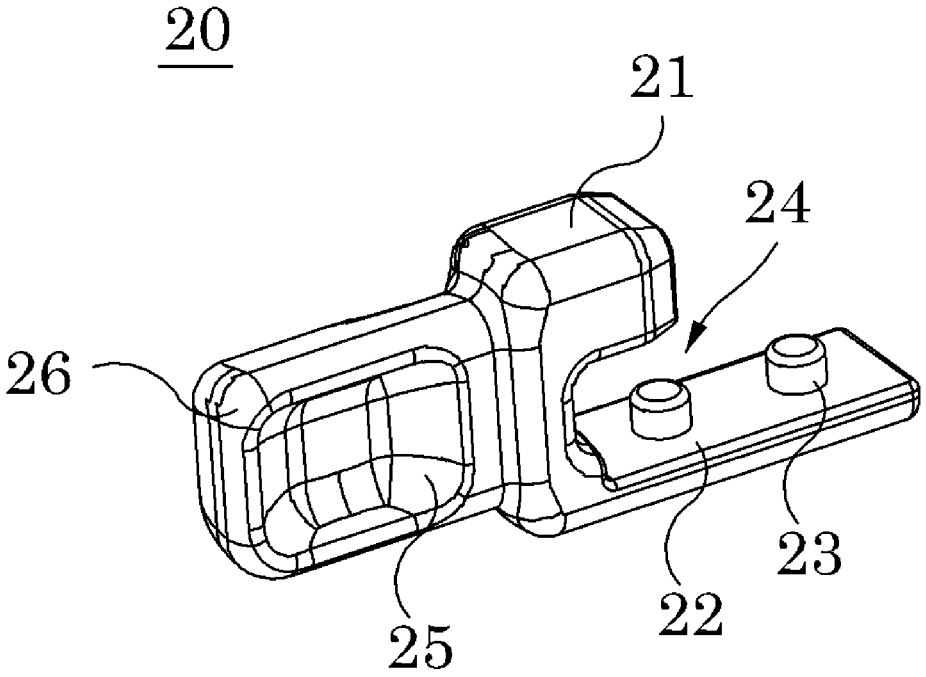
FIG. 6 shows a tooth 20 applied to the present invention.

FIG. 6 shows one of teeth 20 applied to the present invention.

Each of the teeth 20 is formed in an integral body, and includes a meshing part 26 and attachment parts 21 and 22. The meshing part 26 has a groove 25 formed at one side and a protrusion formed at the opposite side for the meshing. Therefore, the teeth 20 in one side are meshed with the teeth 30 in the other side in such a way that the protrusions of the teeth 20 in one side are received in the grooves of the teeth 30 in the other side as shown in FIG. 1.

The attachment parts 21 and 22 are shaped in "C" such that a space 24 receiving the edges 104 and 105 of the slider 100 is formed therebetween. The lower attachment part 22 is formed relatively longer than the upper attachment part 21, and a coupling protrusion 23 is formed on the lower attachment part 22 and is inserted in the tape 10 such that the teeth 20 are fixed to the tape 10.

Hereinafter, the coupling and operation of the slider assembly with above-described structure will be described.

Figure 7:
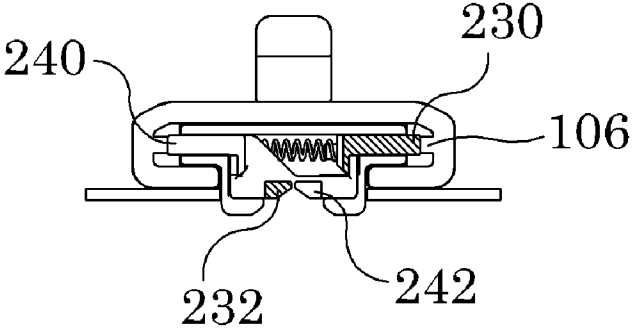
FIGS. 7 to 9 show movement of the stopper depending on forward and backward movement of the bottom stop and hooking operation of the hook piece of the slider, in which left drawings of FIGS. 7A, 8A, and 9A are sectional views taken along lines A-A' of their right drawings.
Figure 7:
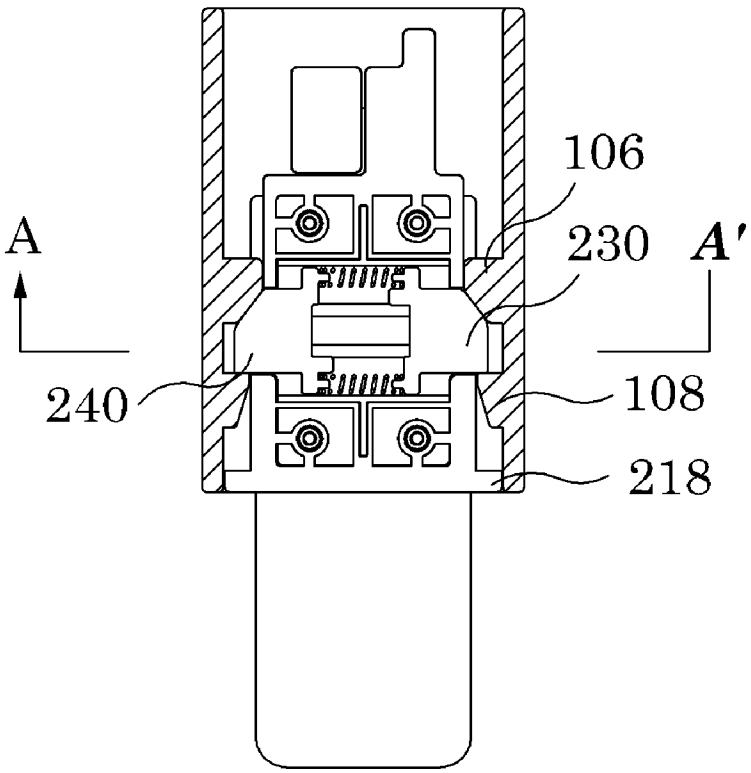
Figure 8:
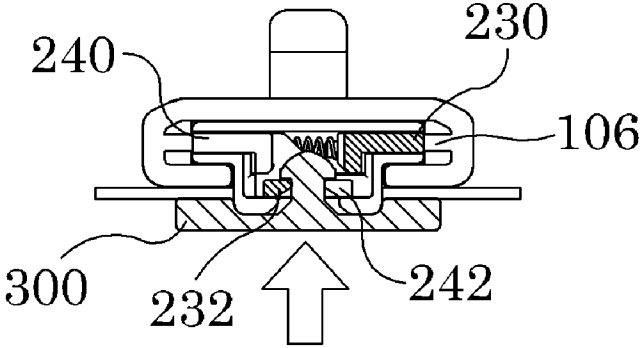
Figure 8:
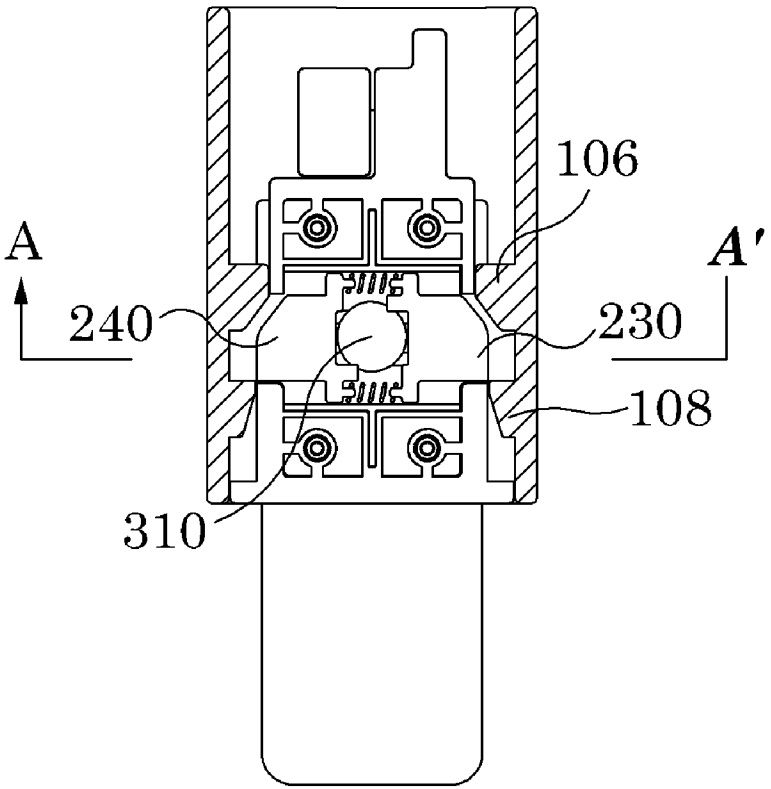
Figure 9:
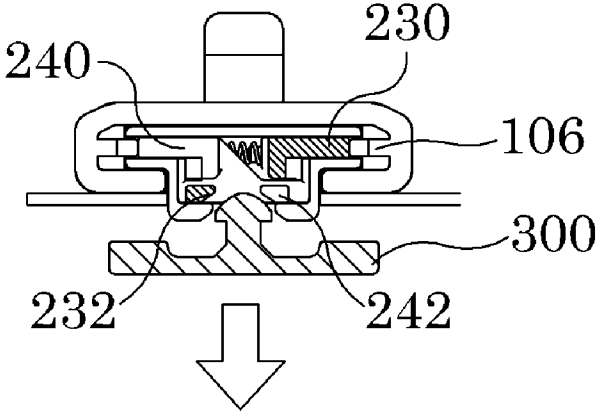
Figure 9:
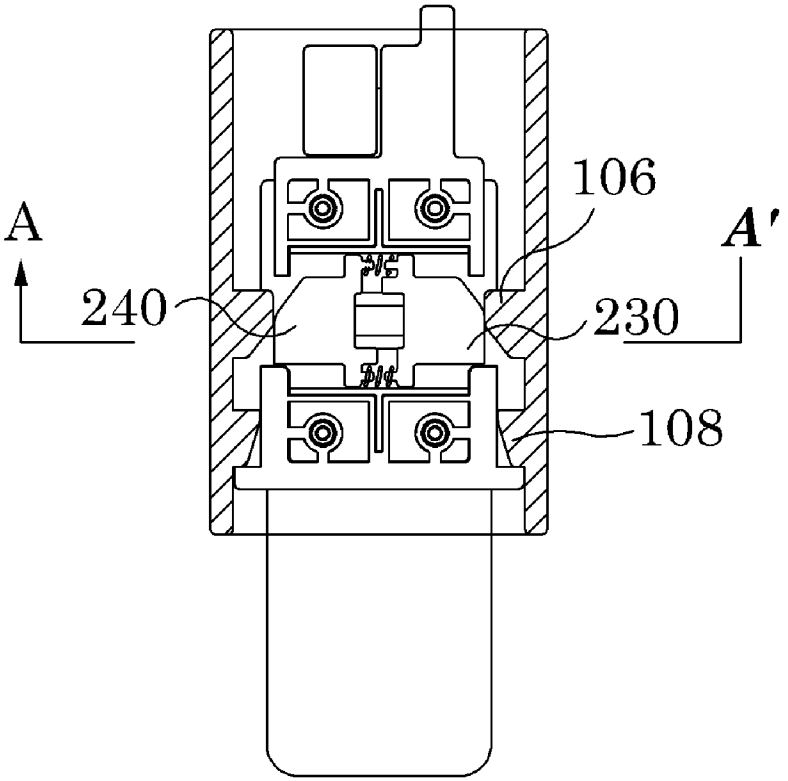

FIGS. 7 to 9 show movement of the stoppers 230 and 240 depending on forward and backward movement of the bottom stop 300 and hooking operation of the hook pieces 106 and 108 of the slider 100, in which left drawings of FIGS. 7A, 8A, and 9A are sectional views taken along lines A-A' of their right drawings.

The locking unit 200 is fixed at the end portion of the tape 10 where the teeth 20 are disposed, and the bottom stop 300 is fixed at the end portion where the teeth 30 are disposed.

When the slider 100 is horizontally pushed with respect to the locking unit 200, the edges 104 and 105 of the slider 100 move along the bottoms of the flanges 213 formed at both sides of the main body 210 of the locking unit 200, as described above.

At this time, as shown in FIG. 7, since the stoppers 230 and 240 of the locking unit 200 are in a state protruded to the most external positions, the hook piece 108 is hooked to the stoppers 230 and 240 while the slider 100 moves.

When the slider 100 is forcibly pushed backward, the restoring force of the spring 234 allows the stoppers 230 and 240 spaced far to forcibly narrow, and simultaneously when the hook piece 108 passes through the stoppers 230 and 240 and moves backward, the stoppers 230 and 240 are again protruded between the hook pieces 106 and 108 due to the restoring force of the spring 234.

In this state, when the force applied to the slider 100 is removed, the slider 100 is locked in the state as shown in FIG. 7, and thus the coupling of the slider 100 and the locking unit 200 are completed.

FIG. 7 shows a state of the stoppers 230 and 240 before the bottom stop 300 is coupled to the locking unit 200. In the first coupled state, when the stoppers 230 and 240 are pushed in a direction distant from each other, the contacts 232 and 242 approach each other on the contrary. Since the restoring force of the spring 234 fully acts on the stoppers 230 and 240, the stoppers 230 and 240 are in the most distant state.

In this state, the hook piece 108 is hooked by the stoppers 230 and 240 such that the hook piece 108 does not move forward and also does not move backward due to the stop jaw 218 of the main body 210 of the locking unit 200. As a result, since the slider 100 is fixed to a constant position before the bottom stop 300 is coupled, a user can find the slider 100 rapidly and conveniently when fastening the zipper.

FIG. 8 shows a state that the bottom stop 300 is coupled with the locking unit 200.

Upon coupling, when the hemispherical anchor 310 rises to pressurize the contacts 232 and 242 of the stoppers 230 and 240, the contacts 232 and 242 slide along the outer surface of the anchor 310 so that the distance between the contacts 232 and 242 goes far and is then sharply narrowed while passing through the hook jaw 314 formed at a boundary with the support 312. As a result, both edges of the stoppers 230 and 240 are pushed inward further than the end portion of the hook jaw 108. This is because the diameter of the support 312 is less than the diameter of the anchor 310, as described above.

Also, the support protrusion 215 of the main body 210 of the locking unit 200 and the support protrusion 320 of the bottom stop 300 come close to each other and are coupled to thereby support the first teeth 20 and 30, and the groove 216 of the support protrusion 215 and the groove 322 of the support protrusion 320 are joined to form a groove, which receives the position determining protrusion 107.

In this state, as shown in FIG. 8, both edges of the stoppers 230 and 240 are pushed inward further than the end portion of the hook piece 108 such that the hook piece 108 can move freely.

Therefore, when a user pulls the full tap 120 upward and moves the same forward, the slider 100 moves in a state that the edges 104 and 105 of the slider 100 are received in the receiving space 24 of the teeth 20 and 30, and in this state, the protrusions of the adjacent teeth 20 and 30 are inserted into the groove 25 and thus the teeth 20 and 30 are meshed, i.e., the zipper is fastened.

FIG. 9 shows a state that the bottom stop 300 is separated from the locking unit 200.

When a user tries to unfasten the zipper by separating the teeth 20 and 30, the user pulls the slider 100 downward to move the slider backward, whereby the hook piece 106 positioned at the front side contacts the stoppers 230 and 240.

At this time, when the slider 100 is strongly pulled, the hook piece 106 pushes the stoppers 230 and 240 and thus the stoppers 230 and 240 are brought to the nearest position, but the interval between the contacts 232 and 242 goes to the farthest position. Since the interval is wider than the diameter of the anchor 310 of the bottom stop 300, the bottom stop 300 can be smoothly separated.

While this invention has been particularly shown and described with reference to preferred embodiments thereof, it will be understood by those skilled in the art that various changes in form and details may be made therein without departing from the spirit and scope of the invention. Thus, the scope of the present invention is to be determined by the broadest permissible interpretation of the following claims and their equivalents, and shall not be restricted or limited by the foregoing detailed description.

What is claimed is:

1. A zipper fastener comprising:

a pair of tapes facing each other, each of said tapes having a plurality of teeth attached thereto for fastening and unfastening operation;

a slider having a generally C-shaped cross section with a top portion, a pair of side portions, and an open bottom portion;

a locking unit attached to an end of one of said tapes, said locking unit including a pair of stoppers received in an inner space of the slider; and a bottom stop disposed below a corresponding end of the other one of said tapes and attached thereto, the bottom stop including an anchor protruding in an upward direction, said anchor configured to retractably position between said stoppers of the locking unit in response to an up and down movement of the bottom stop to selectively allow and disallow a sliding movement of the slider for the fastening and unfastening operation of the tapes, wherein the locking unit is configured to have a lock position with the pair of stoppers at a first position for locking the locking unit against the slider and with the anchor of the bottom stop not engaged between the pair of stoppers, a fastening position with the pair of stoppers at a second position for allowing fastening movement of the slider to fasten the teeth and with the anchor of the bottom stop engaged between the pair of stoppers, and an unfastening position with the pair of stoppers at a third position for allowing unfastening movement of the slider to unfasten the teeth while allowing disengagement of the anchor of the bottom stop from the pair of stoppers.

2. The zipper fastener of claim 1, wherein the pair of stoppers have a shape symmetrical to each other.

3. The zipper fastener of claim 1, wherein the slider includes at least one hook protrusion protruded from an inner wall of the slider.

4. The zipper fastener of claim 3, wherein the locking unit includes at least one spring installed between the pair of stoppers for biasing the stoppers in outward direction, and wherein, at the first position of the locking unit, the pair of stoppers are at an outermost position with the spring biasing the stoppers in outward direction to lock the stoppers into the slider by means of the at least one hook protrusion of the slider.

5. The zipper fastener of claim 4, wherein the slider includes at least two hook protrusions protruded from the inner wall of the slider, and the stoppers are locked between the hook protrusions when the locking unit is at the first position.

6. The zipper fastener of claim 5, wherein the slider includes a first hook protrusion of larger size and a second hook protrusion of smaller size.

7. The zipper fastener of claim 6, wherein the first hook protrusion of the slider has a pressurizing surface configured to abut and push the pair of stoppers when the slider is operated in unfastening direction.

8. The zipper fastener of claim 4, wherein the anchor of the bottom stop includes an upwardly-extending shaft portion and a distal head portion enlarged from the shaft portion, and wherein, at the second position of the locking unit, the pair of stoppers are at an intermediate position with the shaft portion of the anchor engaged between the pair of stoppers.

9. The zipper fastener of claim 8, wherein, at the third position of the locking unit, the pair of stoppers are at an innermost position with the anchor disengaged from the pair of stoppers.

10. The zipper fastener of claim 8, wherein each of the pair of stoppers includes an outer body portion configured to contact with the slider, an inner contact portion configured to selectively engaging with the anchor, and a bridge portion bridging between the outer body portion and the inner contact portion, wherein the inner contact portion of one of the pair of stoppers is placed between the outer body portion and the inner contact portion of the other one of the pair of stoppers, wherein, at the second position of the locking unit, the anchor is configured to place and engage between the two adjacent inner contact portions of the stoppers.

11. The zipper fastener of claim 10, wherein the head portion of the anchor has a hemi-spherical upper surface and a planar lower surface connecting to the shaft portion, and wherein, at the second position of the locking unit after the head portion of the anchor passes between the adjacent inner contact portions of the stoppers, the outer body portions of the stoppers are retracted toward each other by operation of the spring, which causes the shaft portion of the anchor to be caught between the inner contact portions and, the separation of the anchor is prevented due to the planar lower surface of the head portion.

12. The zipper fastener of claim 1, wherein the slider includes a pair of horizontally inwardly extending flanges defined at the bottom portion of the slider.

13. The zipper fastener of claim 12, wherein the locking unit further comprises:

a main body with flange portions protruded outwardly from both sides of the main body such that horizontally inwardly extending flanges of the slider are positioned under the flange portions of the main body; and a stop jaw horizontally outwardly protruded from at a rear end of the main body to limit reward movement of the slider.

14. The zipper fastener of claim 12, wherein the teeth have a meshing part and an attachment part integrally formed, said meshing part having a groove formed at one side surface thereof and a protrusion formed at an opposing side surface thereof for meshing, wherein the attachment part has a generally C-shaped configuration with a concave space for receiving the horizontally inwardly extending flanges of the slider in the concave space for facilitating the fastening and unfastening operation of the teeth, and the attachment part is configured to affix the corresponding tape thereto.

* * * * *